United States Patent [19]

Strnad

[11] Patent Number: 4,708,123

[45] Date of Patent: Nov. 24, 1987

[54] WOOD BURNING STOVE

[76] Inventor: Steve Strnad, 4173 Rayfield Crt, Mississauga, Ontario, Canada, L4Z 1E6

[21] Appl. No.: 932,293

[22] Filed: Nov. 19, 1986

[51] Int. Cl.[4] ..... F23L 3/00

[52] U.S. Cl. ..... 126/289; 126/61; 126/83; 126/285 A

[58] Field of Search ..... 126/77, 60, 61, 289, 126/290, 287, 285 R, 286, 285 A, 66, 80, 81, 83

[56] References Cited

U.S. PATENT DOCUMENTS

| | | | |
|---|---|---|---|
| 4,280,476 | 7/1981 | Webb | 126/287 |
| 4,373,507 | 2/1983 | Schwartz et al. | 126/289 |
| 4,377,153 | 3/1983 | Flagg | 126/61 |
| 4,430,986 | 2/1984 | Thalis | 126/289 |

FOREIGN PATENT DOCUMENTS

| | | | |
|---|---|---|---|
| 1191060 | 7/1985 | Canada | 126/83 |
| 2549202 | 1/1985 | France | 126/61 |
| 345803 | 4/1931 | United Kingdom | 126/77 |

*Primary Examiner*—James C. Yeung

[57] ABSTRACT

The present invention provides a wood burning stove having an internal damper plate located between first and second combustion chambers within the stove. The damper plate is movable between a chamber dividing and a chamber joining position where the damper plate provides a smoke guide to the interior of the stove allowing the stove door to be opened when the stove is in use.

4 Claims, 3 Drawing Figures

WOOD BURNING STOVE

FIELD OF THE INVENTION

The present invention relates to a wood burning stove for indoor use.

BACKGROUND OF THE INVENTION

Over the last few years indoor wood burning stoves have become ever more popular, particularly in view of the increasing costs of fuel energy. There have been many different designs for maximizing efficiency of these stoves. However, one area in which the indoor wood burning stoves have fallen short is in respect of their cleanliness as a result of smoking problems in the indoor environment.

SUMMARY OF THE PRESENT INVENTION

The present invention provides a wood burning stove which is designed with both efficiency and cleanliness in mind. According to the present invention, the wood burning stove comprises an internal combustion region having first and second combustion chambers which are partially divided by a double baffle which extends forwardly and then bends back rearwardly within the combustion region, an exhaust flue from the second combustion chamber, a damper plate movable between a chamber dividing and a chamber joining position with a perforated portion to allow limited flame passage through the damper plate when in the chamber dividing position and a door for gaining access to the internal combustion region. The damper plate, not only helps in preventing heat escape up the flue but also, when in the chamber joining position forms a smoke guide to the inside of the stove allowing the door to be opened when the stove is in use.

BRIEF DISCUSSION OF THE DRAWINGS

The above, as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
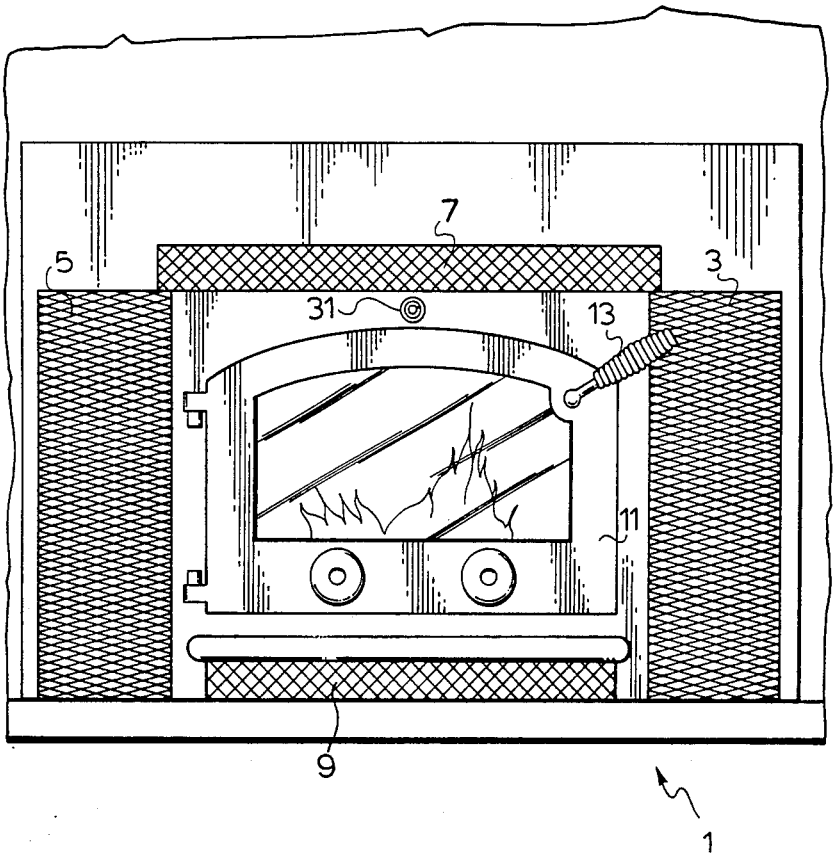
FIG. 1 is a front plane view of a wood burning stove according to a preferred embodiment of the present invention.

FIG. 1 shows the front face of a wood burning stove, generally indicated at 1, mounted in a wall or other supporting structure. The wood burning stove includes an air inlet 3 having an internally mounted blower for drawing relatively cool room air into the stove. By virtue of the stoves internal construction this air is drawn across the back of the stove and blown outwardly through heated air outlet 5. Provided at the top and the bottom of the stove are further air ducts 7 and 9. These two ducts form both cold air inlets and heated air outlets in that the side closest to air inlet 3 will also act under the operation of the blower to draw in relatively cool air which is then blown outwardly through the side of the ducts nearest to heated air outlet 5.

Figure 2:
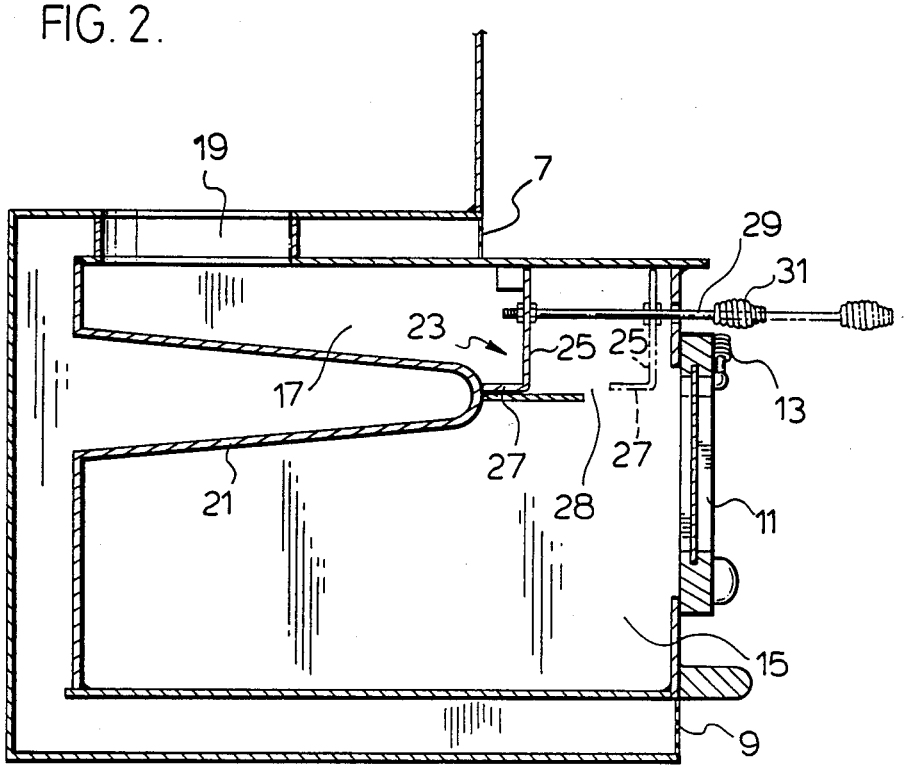
FIG. 2 is a sectional view through the stove of FIG. 1.

The internal components of the stove are seen in FIG. 2 which shows a combustion region comprising a first main combustion chamber 15 and a second combustion chamber 17 which communicates directly with exhaust flue 19. The two combustion chambers are partially divided by an internal baffle 21 which is fed air directly from air inlet 3. This internal baffle, which doubles back on itself, presents a very substantial surface area along which the relatively cool outside air passes and picks up heat energy through heat transfer from the two internal combustion chambers to either side of the baffle.

Figure 3:
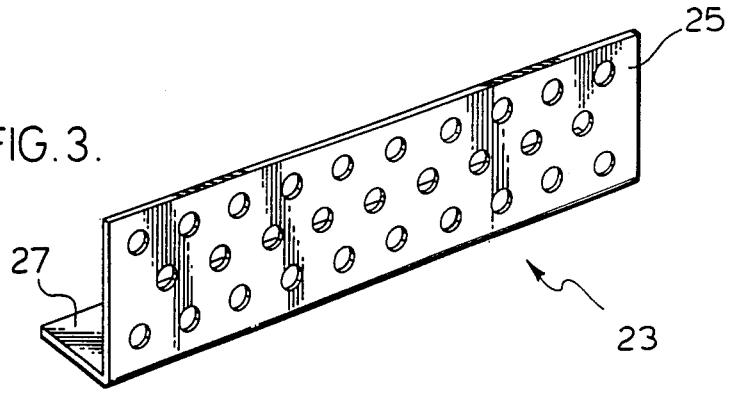
FIG. 3 is an enlarged perspective view of the damper plate used in the stove of FIG. 1.

One of the key features of the stove is the provision of a damper plate, generally indicated at 23. This damper plate, which is best seen in FIG. 3 of the drawings, has a right angular construction with a lower solid plate portion 27 and an upwardly extending perforated plate portion 25. It is movable from a chamber dividing position, as shown in solid lines, to a chamber joining position, as shown in dotted lines, in FIG. 2.

The stove further includes a front door 11 for gaining access to the inside of the stove. Door 11 is provided with a handle portion 13 for opening and closing the door.

Under normal operating conditions, with the stove door closed, damper plate 23 is moved to the solid line chamber dividing position. In this position, the damper plate prevents the flames in the lower combustion region from escaping directly up the flue and thereby reduces heat loss from the stove. However, the perforated portion of the damper plate does provide a very limited flame passage into chamber 17 so that this chamber is still filled with relatively hot combustion gases to provide an effective heating on the upper side of baffle 21 without allowing a major flame escape through the flue.

At times the stove door must be opened while the stove is in operation to, for example, insert a fresh load of wood. Here it is important that little, if any, smoke escape from the stove when the door is open, which is prevented in the present invention by moving the damper plate to the dotted line chamber joining position, i.e. in this position chamber 15 is in direction communication with chamber 17 through opening 28 between the two chambers. Further in this chamber joining position the solid bottom plate portion of the chamber plate forms a smoke and flame guide which directs the smoke and flame of combustion chamber 15 inwardly away from the door allowing the door to be opened.

As will be appreciated, if left up to the user of the stove, there will be times when one will forget to first move the damper plate to the chamber joining or interior smoke guide position. Therefore, in accordance with a further preferred embodiment of the present invention this damper plate, which is provided with an outside control arm 29 further includes an enlarged spring portion 31. This spring portion is located to somewhat overlap the edge of the front door and block the door from being opened without first moving the damper plate through its control arm to the dotted line position where the door will then clear past spring 31.

The reason for making member 31 of a spring construction is that it will then have some give and substantially reduce any potential damage to the top of the stove door in the event that one does pull the door open without first clearing the spring. This is particularly important when considering that the door may be made of expensive material, such as brass or may even be gold plated for esthetic purposes.

Although various preferred embodiments of the invention have been described herein in detail, it will be appreciated that variations may be made without departing from the spirit of the invention or the scope of the appended claims.

The embodiments of the invention in which an exclusive property or privilege is claimed are defined as follows:

1. A wood burning stove comprising an internal combustion region having front and rear walls with a double baffle extending generally horizontally forwardly from said rear wall to divide said internal combustion region in to a lower fuel receiving chamber and an upper chamber leading to an exhaust flue located thereabove, said baffle having heat transfer surfaces in both of said chambers and terminating short of said front wall leaving a passage between said lower and upper chambers, a damper plate movable between a passage closed chamber dividing and a passage open chamber joining position, said damper plate having a perforated portion to allow limited flame travel therethrough when in the chamber dividing position, and a door for gaining access through said front wall to said internal combustion region at said passage between said lower and upper combustion chambers, said damper plate when in the chamber joining position acting as a smoke guide to guide smoke to the inside of said stove when said door is opened.

2. A wood burning stove, as claimed in claim 1, including means for preventing opening of said door without first moving said damper plate to the chamber joining position immediately in front of said door.

3. A wood burning stove, as claimed in claim 2, including a control arm for said damper plate, said control arm being located adjacent and having an enlarged spring fitted therearound for blocking opening of said door without moving said damper plate to the chamber joining position.

4. A wood burning stove, as claimed in claim 1, wherein said damper plate has a ring angular construction including a solid bottom plate portion with said perforated portion comprising an upright plate portion extending upwardly from said bottom plate portion.

* * * * *